US006954603B2

(12) United States Patent
Brown et al.

(10) Patent No.: US 6,954,603 B2
(45) Date of Patent: Oct. 11, 2005

(54) FUSER OIL CONTAMINATION PREVENTION AND CLEAN-UP METHOD

(75) Inventors: Kenneth J. Brown, Penfield, NY (US); Amy J. Deyaeger, Rochester, NY (US); David E. Hockey, Brockport, NY (US); Thomas N. Tombs, Brockport, NY (US); Diane M. Herrick, Rochester, NY (US); David M. Rakov, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 122 days.

(21) Appl. No.: 10/667,797

(22) Filed: Sep. 22, 2003

(65) Prior Publication Data

US 2004/0120742 A1 Jun. 24, 2004

Related U.S. Application Data

(60) Provisional application No. 60/435,047, filed on Dec. 20, 2002.

(51) Int. Cl.[7] ..... G03G 15/16; G03G 21/00

(52) U.S. Cl. ..... 399/101; 399/127; 399/297; 399/309; 399/343

(58) Field of Search ..... 399/98, 101, 127, 399/297, 309, 324, 325, 343; 15/256.51, 256.52

(56) References Cited

U.S. PATENT DOCUMENTS

| | | | | |
|---|---|---|---|---|
| 5,619,314 A | * | 4/1997 | Kubo | 15/256.51 |
| 5,689,790 A | * | 11/1997 | Kubo et al. | 399/343 |
| 5,705,447 A | * | 1/1998 | Kubo | 15/256.51 |
| 5,742,873 A | * | 4/1998 | Kubo et al. | 399/98 |
| 5,835,831 A | * | 11/1998 | Staudenmayer et al. | 399/309 |
| 5,903,802 A | * | 5/1999 | Watanabe et al. | 399/98 |
| 6,173,136 B1 | * | 1/2001 | Fuchiwaki et al. | 399/325 |
| 6,222,606 B1 | * | 4/2001 | Fuchiwaki et al. | 399/309 |

* cited by examiner

*Primary Examiner*—William J. Royer
(74) *Attorney, Agent, or Firm*—Lawrence P. Kessler

(57) ABSTRACT

In order to prevent an imaging forming process of an electrostatographic reproduction apparatus from becoming contaminated with fuser release oil, a substantially uniform layer of pigmented marking particles from a development subsystem of the image forming process is deposited onto a photoconductive member of the image forming process during any non-imaging cycles of the process, including cycle down, non-imaging skip frames, or recovery from a receiver jam. The substantially uniform layer of pigmented marking particles acts as a barrier to block fuser release oil from the photoconductive member and as a vehicle to carry away contaminating fuser release oil.

32 Claims, 12 Drawing Sheets

FUSER OIL CONTAMINATION PREVENTION AND CLEAN-UP METHOD

This application claims the benefit of provisional application No. 60/435,047, filed Dec. 20, 2002.

FIELD OF THE INVENTION

This invention relates to preventing the image forming process of an electrostatographic reproduction apparatus from being contaminated by fuser release oil and, if such contamination already has occurred, to cleaning contaminating fuser release oil from electrostatographic reproduction apparatus subsystems.

BACKGROUND OF THE INVENTION

In typical commercial reproduction apparatus (electrographic copier/duplicators, printers, or the like), a latent image charge pattern is formed on a uniformly charged charge-retentive or photoconductive member having dielectric characteristics. Pigmented marking particles are attracted to the latent image charge pattern to develop such image on the photoconductive member. A receiver member, such as a sheet of paper, transparency, or other medium, is then brought into contact with the photoconductive member, and an electric field applied to transfer the marking particle developed image to the receiver member from the photoconductive member. The electric field to transfer the marking particle developed image to the receiver member from the photoconductive member is typically applied by spraying the backside of the receiver member with electrically charged ions from a corona charging device or, alternatively, by contacting the backside of the receiver member with an electrically biased transfer member. The electrically biased transfer member may be an electrically biased roller in contact with the receiver member or an electrically biased roller in contact with a transport member, such as a flexible belt, on which the receiver member is carried. Another alternative is to first transfer the marking particle developed image directly to an electrically biased intermediate transfer member in the form of a roller or belt and then from the intermediate transfer member to the receiver member.

After transfer to the receiver member, by any of the above alternatives, the receiver member bearing the transferred image is transported to a fixing device where the image is fixed (fused) to the receiver member by heat and/or pressure to form a permanent reproduction thereon. Typically the fixing device has a nip formed between a pair of rollers, one of which, hereafter referred to as the fuser roller, is heated to a temperature high enough to fuse the marking particle image to the receiver member as the receiver member is passed through the nip with the side bearing the marking particle image in contact with the fuser roller. In order to prevent particles of the marking particle image, or the receiver member bearing the fused marking particle image, from sticking to the fuser roller, release oil is typically applied to the fuser roller. After exiting the fuser roller nip a quantity of the release oil typically remains on the receiver member, especially on the side that contacted the fuser roller.

To print an image on both sides of the receiver member, hereafter referred to as duplex printing, a fused marking particle image is formed on side one of the receiver member by the above process, whereafter the receiver member is returned to the process via a duplex return path. In this duplex return path, the receiver member is turned over so as to have a second marking particle developed image transferred and fused to side two of the receiver member. In duplex printing, when transferring the marking particle developed image to side two of the receiver member, if the electric field for transfer is applied by an electrically biased transfer member as described above, some of the fuser release oil from side one of the receiver member, which is now in contact with the biased transfer member, transfers to the surface of the biased roller. During a long duplex printing run a relatively large amount of fuser release oil can thereby accumulate on the biased transfer member. During times such as cycle-down, non-imaging skip frames, and recovery from receiver jams, the biased transfer member is in direct contact with the photoconductive member. During these times some of the fuser release oil accumulated on the biased transfer member during duplex printing transfers to the photoconductive member and can cause image quality defects during subsequent printing. The intermediate transfer member alternative mentioned above also provides a path for fuser release oil to contaminate the photoconductive member. In this case, during duplex printing, fuser release oil from side one of the receiver members accumulates on the electrically biased transfer member that transfers the marking particle developed image from the intermediate transfer member to the receiver member. Then during times such as cycle-down, non-imaging skip frames, and recovery from receiver jams the biased transfer member is in direct contact with the intermediate transfer member. The oil then transfers to the intermediate transfer member and from the intermediate transfer member to the photoconductive member.

SUMMARY OF THE INVENTION

In view of the above, it is the object of the present invention to prevent fuser release oil contamination of the photoconductive member and other subsystems of an electrostatographic reproduction apparatus. We have discovered that the pigmented marking particles that render the latent image charge pattern visible at the development step of the imaging process can also be used to prevent fuser release oil from transferring from the biased transfer member to the photoconductive member or to the intermediate transfer member if that transfer alternative is being used. Normally at the end of a printing run the reproduction apparatus goes into a cycle down mode during which no more receiver members are fed from their supply, but during which, remaining process steps such as cleaning of the photoconductive member, fusing of the last several receiver members, and any finishing operations are completed. Depending on the configuration of the imaging process in the reproduction apparatus, the cycle down period might last for several rotations of the photoconductive member.

During the cycle down period for the reproduction apparatus, the biased transfer member is in direct contact with the photoconductive member, or with the intermediate transfer member if that transfer alternative is being used. If the just completed printing run was a duplex printing run, some of the fuser release oil that had accumulated on the biased transfer member from side one of the receiver members can transfer from the biased transfer member to the photoconductive member, or to the intermediate transfer member if that transfer alternative is being used. Another opportunity for fuser release oil to contaminate the photoconductive member is during non-imaging skip frames, which can occur for a variety of reasons.

Generally, the present invention is to use a uniform layer of marking particles on the surface of the photoconductive member, or intermediate transfer member if used, as a barrier to prevent fuser release oil from transferring from the biased transfer member to the photoconductive member, or intermediate transfer member if used. Specifically, the present invention is to deposit, from the development subsystem, onto the surface of the photoconductive member, a uniform layer of the marking particles, during any of the non-imaging periods when the photoconductive member, or intermediate transfer member, if used, is in operative contact with the biased transfer member, during or after a duplex printing run. The fuser release oil from the biased transfer member transfers to the marking particles, but not to the photoconductive member, or intermediate transfer member if used, and is carried away with the marking particles when they are removed by a cleaning device such as scraper blade, rotating fiber brush, or any other means capable of removing them.

It is also the object of the present invention to remove fuser release oil contamination from the photoconductive member of an electrostatographic reproduction apparatus, if, for any reason, the photoconductive member has become contaminated with fuser release oil in spite of the above described prevention method. Generally, the clean-up process is to coat the surface contaminated with fuser release oil with a uniform layer of marking particles that pick off and carry away the fuser release oil when they are subsequently removed by a cleaning device such as scraper blade, rotating fiber brush, or any other means capable of removing them. Specifically, the clean-up process is to deposit a uniform layer of the pigmented marking particles from the development subsystem onto the photoconductive element for a predetermined number of non-imaging cycles. No receiver members are fed into the process during these non-imaging cycles, so the uniform layer of marking particles is transferred to the biased transfer member. A cleaning device such as a scraper blade, rotating fiber brush, or any other device capable of removing marking particles removes the uniform layer of marking particles from the biased transfer member. Any fuser release oil that has accumulated on the biased transfer member during duplex printing is carried away by the pigmented marking particles. The method is essentially the same if the intermediate transfer member alternative is used. In this case a uniform layer of the pigmented marking particles is again deposited from the development subsystem onto the photoconductive member for a predetermined number of non-imaging cycles. Since no receiver members are being fed during these intervals, the uniform layer of pigmented marking particles transfers to the intermediate transfer member and then to the electrically biased member that normally causes the marking particles to be transferred to the receiver members. The uniform layer of pigmented marking particles is removed from the biased transfer member by a cleaning device such as a scraper blade, rotating fiber brush, or any other device capable of removing them. Any fuser release oil that has accumulated on the biased transfer member during duplex printing is carried away by the pigmented marking particles.

The invention, and its objects and advantages, will become more apparent in the detailed description of the preferred embodiments presented below.

BRIEF DESCRIPTION OF THE DRAWINGS

In the detailed description of the preferred embodiments of the invention described below, reference is made to the accompanying drawings, in which.

DETAILED DESCRIPTION OF THE INVENTION

Electrostatographic reproduction apparatus generally are well known. Therefore the present description will be directed in particular to elements forming part of, or cooperating more directly with the present invention. There exist many different embodiments of the electrographic image forming process used in such reproduction apparatus. This description will use two examples to teach the present invention, but it must be understood that the present invention is not limited to these examples, but rather could be practiced in any embodiment with the same image forming steps.

Figure 1A:
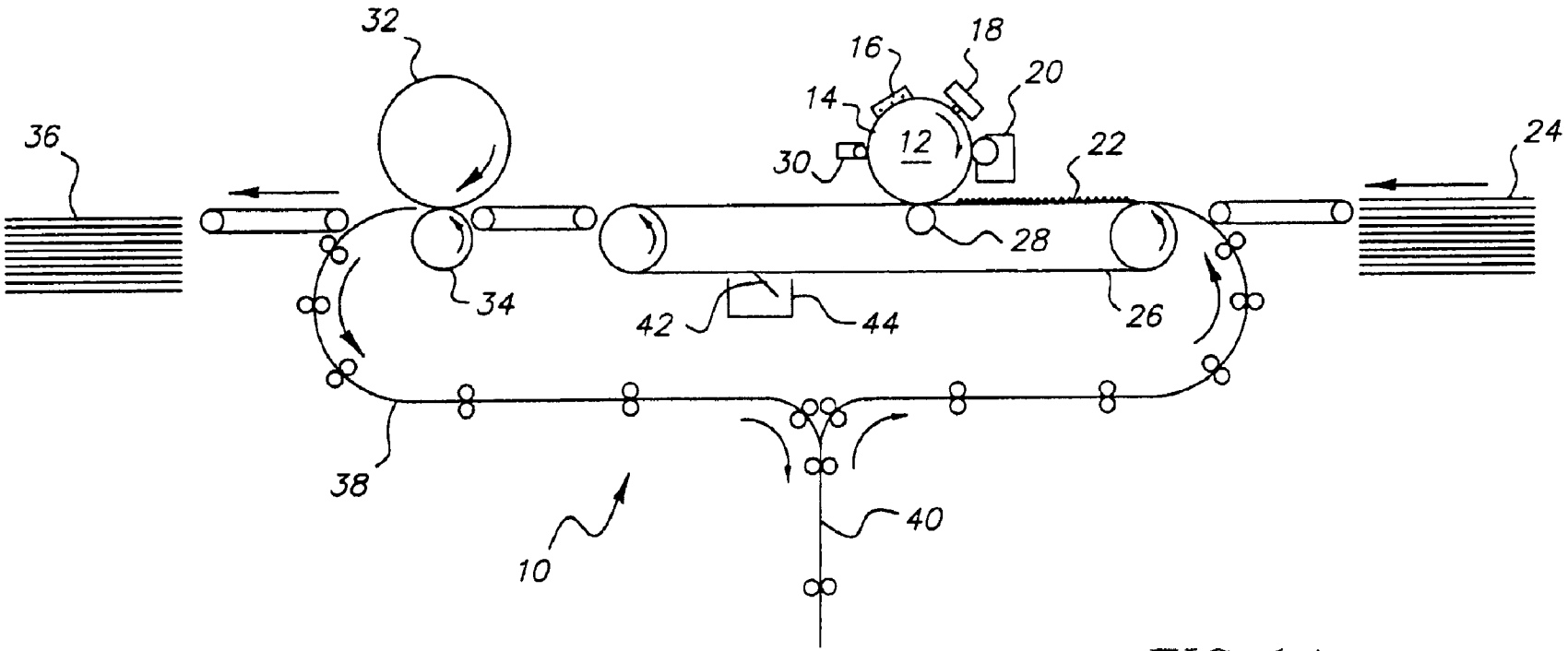
FIG. 1A is a schematic illustration of a side view of an electrographic reproduction apparatus in which the present invention would be employed, with a receiver sheet shown on a transport belt about to enter the nip formed between a photoconductive member and an electrically biased transfer roller.
Figure 1B:
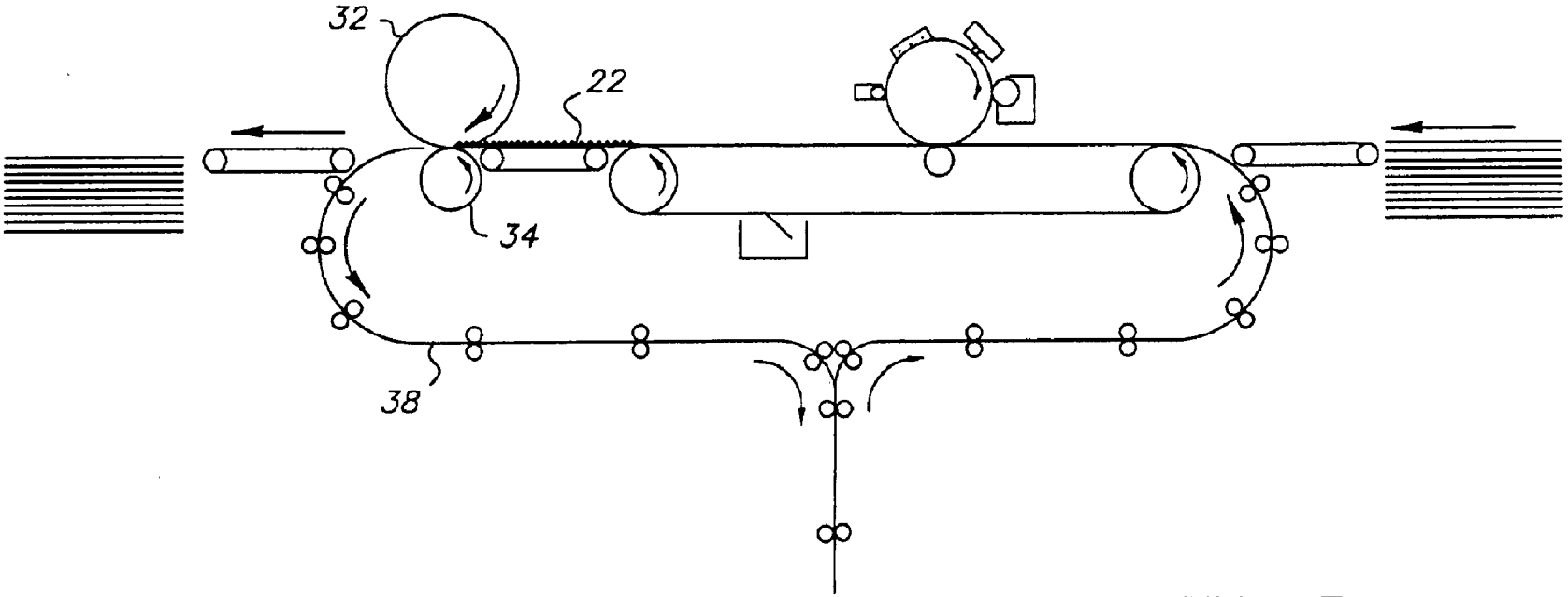
FIG. 1B is a schematic illustration of the same electrographic reproduction apparatus as in FIG. 1A with the receiver sheet, bearing a marking particle image on its first side, about to enter the nip between a fuser roller and a pressure roller.

With reference to the electrographic reproduction apparatus 10 as shown in FIG. 1A, an imaging drum 12 is provided on which is coated a photoconductive member 14. The imaging drum 12 is selectively rotated, by any well-known drive mechanism (not shown), in the direction indicated by the arrow, to advance the photoconductive member 14 past a series of subsystems of the electrographic reproduction apparatus 10. A primary charging device 16 is provided to deposit a uniform electrostatic charge onto the photoconductive member 14. The uniform charge on the photoconductive member 14 is subsequently selectively dissipated by, for example, a digitally addressed exposure subsystem 18, such as a Light Emitting Diode (LED) array or a scanned laser, to form an electrostatic latent image of a document to be reproduced. The electrostatic latent image is then rendered visible by development subsystem 20, which deposits charged, pigmented marking particles onto the photoconductive member 14 in accordance with the electrostatic charge pattern of the latent image. The developed marking particle image is then transferred to a receiver member 22 that has been fed from supply 24 onto a transport belt 26. The electric field to transfer the marking particle image from the photoconductive member 14 to the receiver member 22 is provided by electrically biased roller 28. In FIG. 1A the receiver member 22 is shown on the transport belt 26 about to enter the nip between the photoconductive member 14 and the electrically biased roller 28. Cleaner 30 cleans any marking particles that are not transferred from the photoconductive member 14 to the receiver member 22. The receiver member 22 bearing the marking particle image is then transported through the nip formed between fuser roller 32 and pressure roller 34 wherein the marking particle image is fused by heat and pressure to the receiver member 22. FIG. 1B shows the receiver member about to enter the nip between the fuser roller 32 and the pressure roller 34.

The combination of elements including the imaging drum 12 on which is coated the photoconductive element 14, the primary charging device 16, the exposure subsystem 18, the development subsystem 20, the electrically biased roller 28, and the cleaner 30 will henceforth be referred to as the imaging module. The electrographic reproduction apparatus 10 depicted in FIGS. 1A–1F could include a plurality of imaging modules in sequence along the length of the transport belt 26 for the purpose of creating and transferring different respective colored marking particle images to the receiver member 22 in superimposed register. The present invention is equally applicable to an electrographic reproduction apparatus with one imaging module or with a plurality of imaging modules.

Figure 1C:
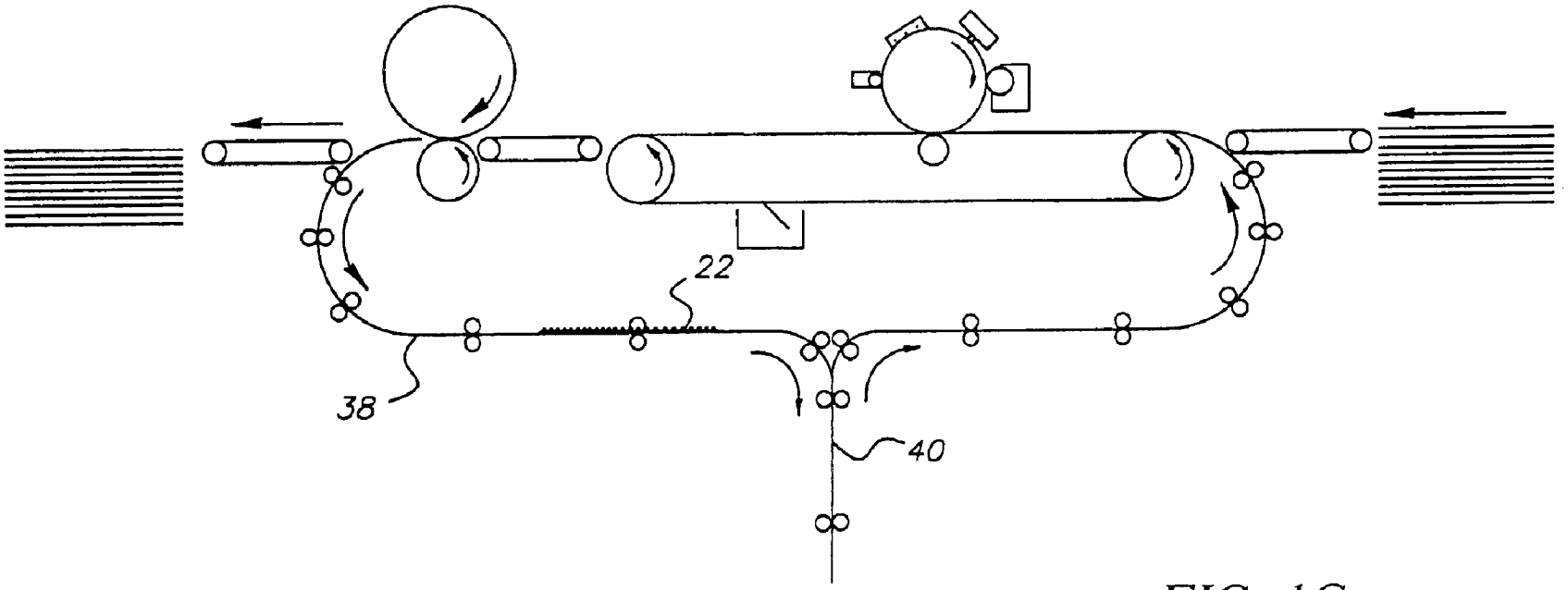
FIG. 1C is a schematic illustration of the same electrographic reproduction apparatus as in FIGS. 1A and 1B with the receiver sheet, bearing the fused marking particle image on its first side, about to enter a turn-over part of a duplex return path.
Figure 1D:
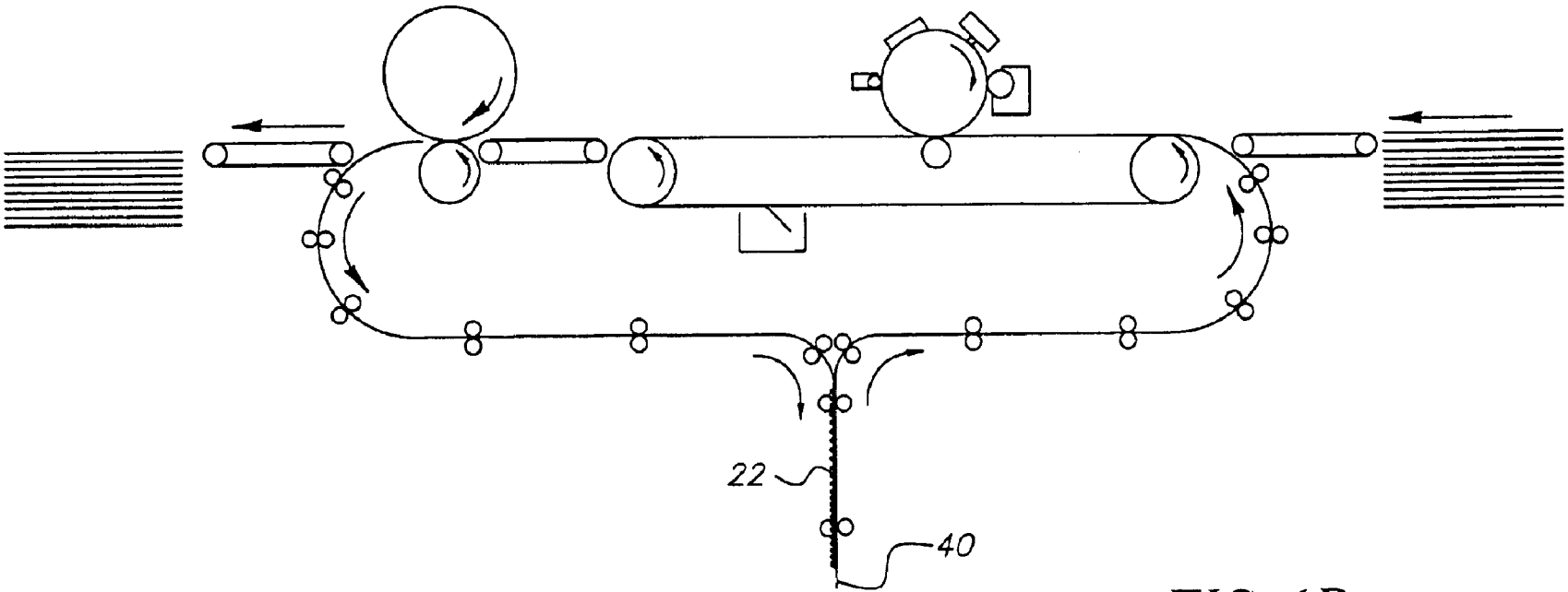
FIG. 1D is a schematic illustration of the same electrographic reproduction apparatus as in FIGS. 1A, 1B, and 1C with the receiver sheet, bearing the fused marking particle image on its first side, in the turnover part of the duplex return path.
Figure 1E:
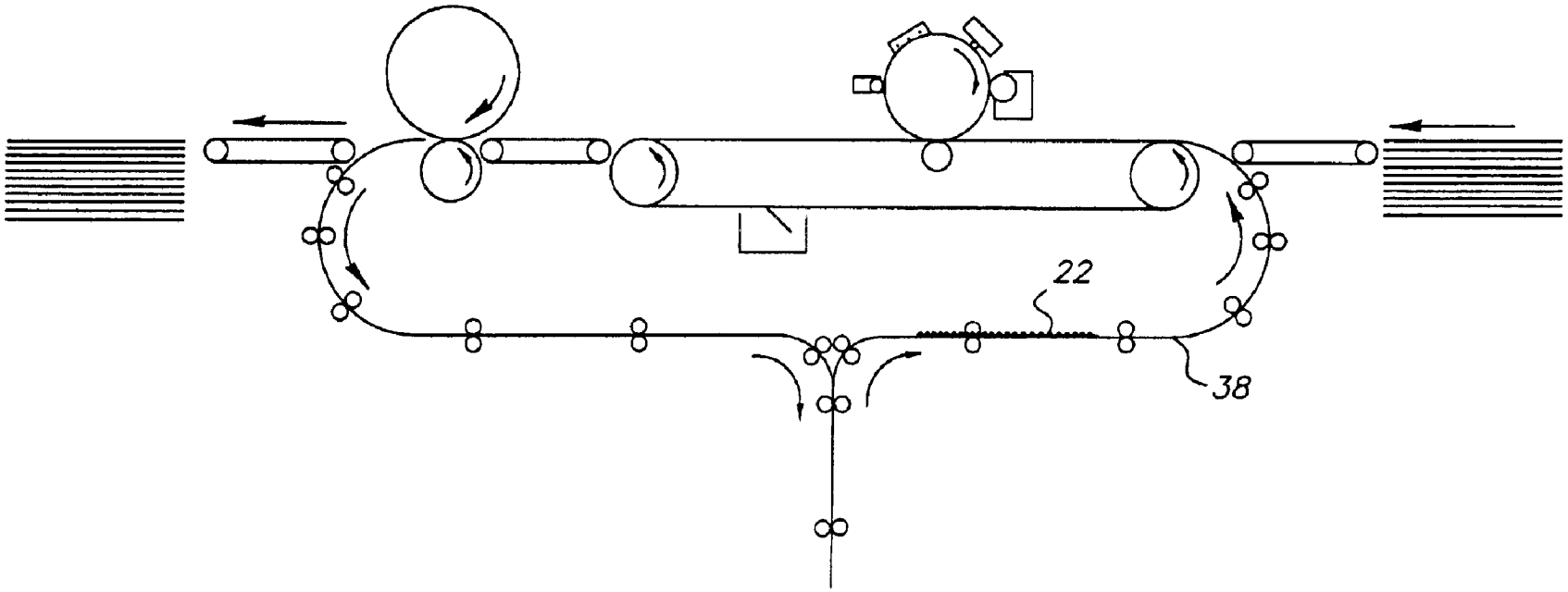
FIG. 1E is a schematic illustration of the electrographic reproduction apparatus in FIGS. 1A, 1B, 1C, and 1D with the receiver sheet, bearing the fused marking particle image on its first side, after exiting the turnover part of the duplex return path.
Figure 1F:
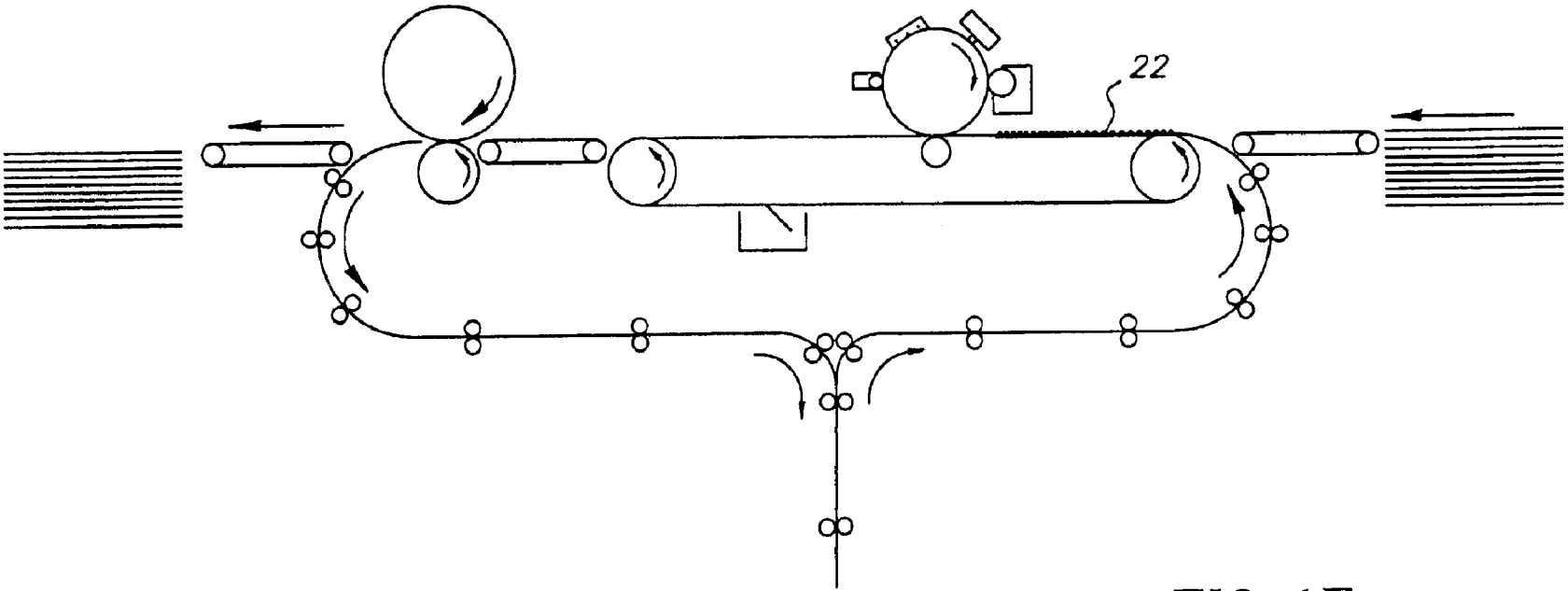
FIG. 1F is a schematic illustration of the electrographic reproduction apparatus in FIGS. 1A, 1B, 1C, 1D, and 1E with the receiver sheet, bearing the fused marking particle image on its first side, on the transport belt and about to enter the nip between the photoconductive member and the electrically biased transfer roller to have a marking particle image transferred to its second side.

The fuser roller 32 is heated to a temperature high enough to fuse the marking particle image to the receiver member 22 as the receiver member 22 is passed through the nip with the side bearing the marking particle image in contact with the fuser roller 32. After exiting the fuser nip, if the print job calls for an image on just side one of the receiver member 22, the receiver member 22 is transported to output stack 36. If the print job calls also for an image on side two (the reverse side) of the receiver member 22, hereafter referred to as duplex printing, the receiver member 22 is not transported to the output stack 36, but rather is diverted to return path 38. FIG. 1C shows the receiver member 22 in the return path after exiting the fuser nip. In return path 38, a portion of the receiver member 22 is turned over in turnover device 40 and then returned to transport belt 26 whereupon a second marking particle image is transferred to side two of receiver member 22. FIG. 1D shows the receiver member 22 in the turnover device 40, FIG. 1E shows the receiver member 22 in a portion of the return path 38 after being turned over by the turnover device 40, and FIG. 1F shows the receiver member 22 back on the transport belt 26 prior to having a marking particle image transferred to its side two. The receiver member 22 bearing the marking particle image on side two is then transported through the nip formed between fuser roller 32 and pressure roller 34 wherein the marking particle image on side two of the receiver member 22 is fused by heat and pressure to side two of the receiver member 22. After exiting the fuser nip the receiver member 22, with images on both sides, is transported to output stack 36.

In order to prevent the receiver member 22 with the fused marking particle image from sticking to the fuser roller 32 as it exits the nip between fuser roller 32 and pressure roller 34, release oil is applied to the fuser roller 32. After exiting the nip between the fuser roller 32 and pressure roller 34, a quantity of the release oil typically remains on the receiver member 22 on the side that contacted the fuser roller 32. During duplex printing, when transferring the marking particle image to side two of the receiver member 22, some of the fuser release oil remaining on side one, from fusing of the side one marking particle image, transfers to the transport belt 26 which is in contact with side one of the receiver member 22. During a long duplex printing run, a relatively large amount of fuser release oil can thereby accumulate on the transport belt 26.

During a printing run of the above process it is sometimes necessary to skip one or more imaging frames of photoconductive member 14. Non-imaging skip frames are created by not feeding any receiver members 22 from supply 24 and inhibiting the digitally addressed exposure subsystem 18, such that no pigmented marking particles are developed in the skip frames by development subsystem 20. One instance that non-imaging skip frames are required is during the production of multiple page, collated documents that are being duplex printed and the number of pages in the document is not equal to an integral of the number of pages it takes to fill the return path 38. Another instance requiring non-imaging skip frames is if sequential receiver members 22, fed from different supplies, require different fuser set points, and additional time is needed to change the fuser set points. During non-imaging skip frames, the photoconductive member 14 is in direct contact with the transport belt 26. As a result, fuser release oil accumulated on transport belt 26, as described above, transfers to photoconductive member 14. Fuser release oil can also transfer from transport belt 26 to photoconductive member 14 during cycle down at the end of a duplex printing run when photoconductive member 14 is again in direct contact with transport belt 26. Another opportunity for direct contact of photoconductive member 14 to transport belt 26 bearing oil is during recovery from a receiver member jam during a duplex printing run. While purging receiver members 22 from the reproduction apparatus 10 after a shutdown due to a jam it is possible for direct contact of the photoconductive member 14 with the transport belt 26 during some frames.

The present invention prevents transfer of fuser release oil from transport belt 26 to photoconductive member 14 during non-imaging skip frames, cycle down, and jam recovery by depositing a uniform layer of marking particles onto photoconductive member 14 because it is during these times that photoconductive member 14 will be in direct contact with transport belt 26. A logic and control system within the reproduction apparatus 10 controls the image printing process previously described, including creating non-imaging skip frames as required, the cycle down sequence, and the recovery from jams of receiver members 22. The logic and control system will determine/detect that frames on the transport belt 26 containing fuser release oil will come into direct contact with the photoconductive member 14 due to non-imaging skip frames, cycle down, or jam recovery. The logic and control system then adjusts the operating parameters of the imaging module so that a uniform layer of marking particles is deposited onto photoconductive member 14 by development subsystem 20 corresponding to those direct contact frames of transport belt 26. For this purpose the imaging module operating parameters are set to a predetermined level so that the uniform layer of marking particles is at least a monolayer of the marking particles. The uniform layer of marking particles acts as a barrier to prevent transfer of fuser release oil from transport belt 26 to photoconductive member 14. The uniform layer of marking particles is transferred from the photoconductive member 14 directly to the transport belt 26 by biased transfer roller 28 and subsequently removed from transport belt 26 by scraper blade 42 and collected in receptacle 44. The fuser release oil from the transport belt 26 adheres to the marking particles and is removed along with the marking particles by scraper blade 42. Of course, in an alternate embodiment, this uniform layer of marking particles could be removed directly from the photoconductive member 14 without being transferred to the transport belt 26. Marking particle removal from the photoconductive member 14 then would be effected by the cleaner 30.

As described above, the transport belt 26 only accumulates fuser release oil during duplex printing when it comes into contact with the first side of receiver members 22 during the transfer of a developed marking particle image to the second side. Therefore, the method of the present invention may be activated only for non-imaging skip frames, cycle down, and jam recovery during duplex printing runs. In addition it has been determined that a minimum duplex printing run length is required before enough fuser release oil accumulates on the transport belt 26 to cause image quality defects. Therefore, the method of the present invention may be activated only for non-imaging skip frames, cycle down, and jam recovery during duplex printing runs longer than this predetermined length.

The overall object of the present invention as described above is to prevent fuser oil contamination of photoconductive member 14. However, if an event should occur that is not anticipated by the logic and control system, during which the photoconductive member 14 is inadvertently contaminated with fuser release oil, another embodiment of the present invention provides a clean-up mode to reproduction apparatus 10. The clean-up mode is initiated, for example, automatically or by the reproduction apparatus operator if observed print quality defects are believed to be due to fuser release oil contamination. In the clean-up mode the operating parameters of the imaging module are adjusted so that a uniform layer of marking particles is deposited continuously onto photoconductive member 14 for a predetermined number of non-imaging cycles during which no receiver members 22 are fed from supply 24. The contaminating fuser release oil on photoconductive member 14 adheres to the marking particles and is carried away with the marking particles as the marking particles are transferred to transport web 26. The fuser release oil bearing marking particles are then removed from transport belt 26 by scraper blade 42 and collected in receptacle 44. The predetermined number of cycles in the clean-up mode is sufficient to thus remove the contaminating fuser release oil from photoconductive member 14 and thereby eliminate the print quality defects caused therefrom. As noted above, an embodiment may be provided where the marking particle layer is not transferred from the photoconductive member 14, but removed directly from the photoconductive member 14 by the cleaner 30.

In this embodiment, depicted in FIGS. 1A–1F, the exemplary device for removing the uniform layer of marking particles from transport belt 26 is a scraper blade 42. Other well-known devices for cleaning marking particles from substrates in electrographic reproduction apparatus are vacuum assisted fiber brushes, electrically conductive fiber brushes, and magnetic brushes. All of these devices are well known in the art and therefore will not be described in detail here. All would serve equally well in place of the scraper blade 42 found in the above-recited embodiment.

Figure 2A:
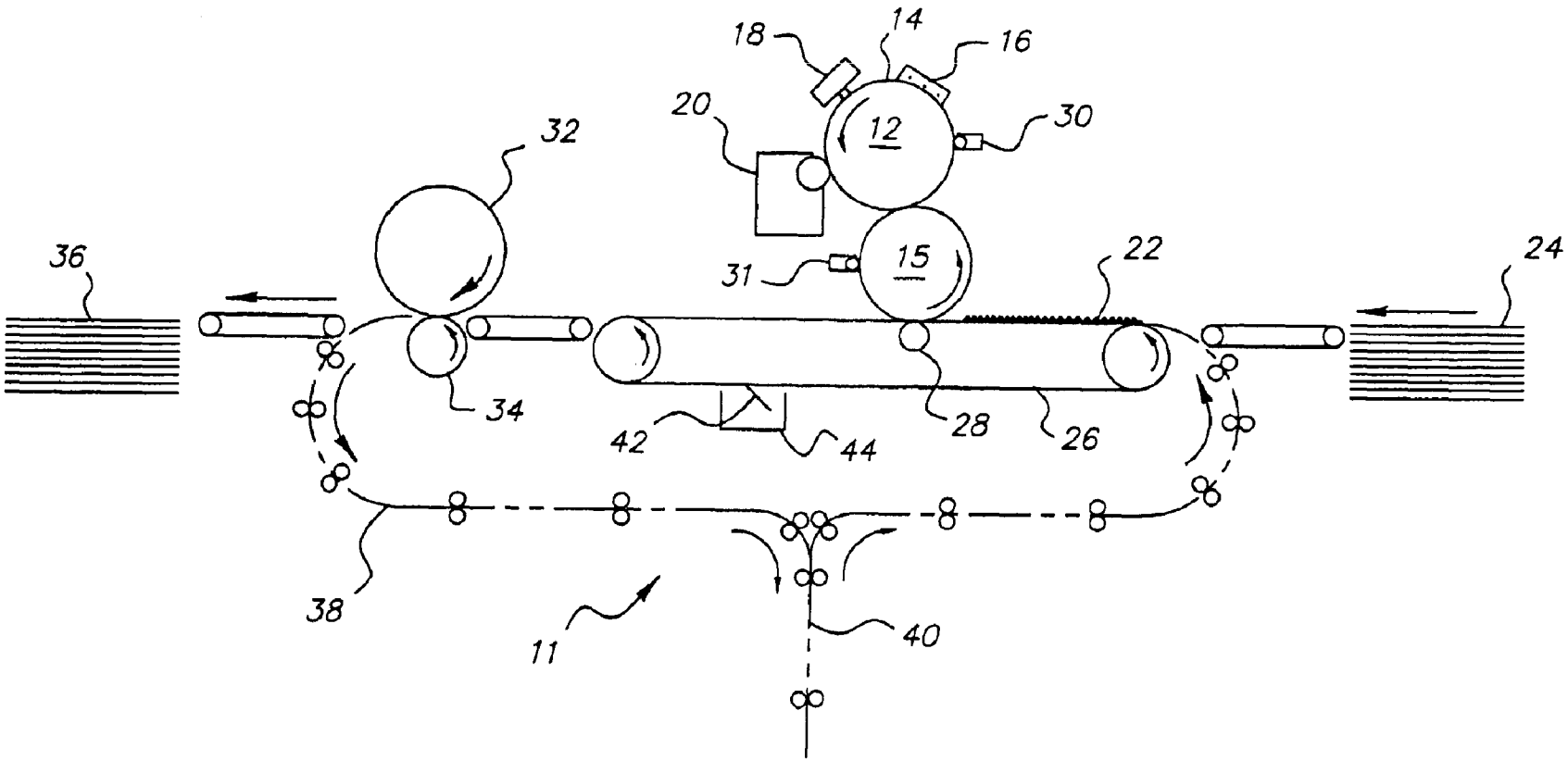
FIG. 2A is a schematic illustration of a side view of another electrographic reproduction apparatus in which the present invention would be employed, with a receiver sheet shown on a transport belt about to enter the nip formed between an intermediate member and an electrically biased transfer roller.

FIGS. 2A–2F illustrate a variation of the electrographic reproduction apparatus 10 in FIGS. 1A–1F in which the present invention can also be practiced. All elements that are common to the two electrographic reproduction apparatus 10, 11 illustrated in FIGS. 1A–1F and FIGS. 2A–2F employ the same reference numerals. With reference to the electrographic reproduction apparatus 11 as shown in FIG. 2A, an imaging drum 12 is provided on which is coated a photoconductive member 14. The imaging drum 12 is selectively rotated, by any well-known drive mechanism (not shown), in the direction indicated by the arrow, to advance the photoconductive member 14 past a series of subsystems of the electrographic reproduction apparatus 11. A primary charging device 16 is provided to deposit a uniform electrostatic charge onto the photoconductive member 14. The uniform charge on the photoconductive member 14 is subsequently selectively dissipated by, for example, a digitally addressed exposure subsystem 18, such as a Light Emitting Diode (LED) array or a scanned laser, to form an electrostatic latent image of a document to be reproduced.

Figure 2B:
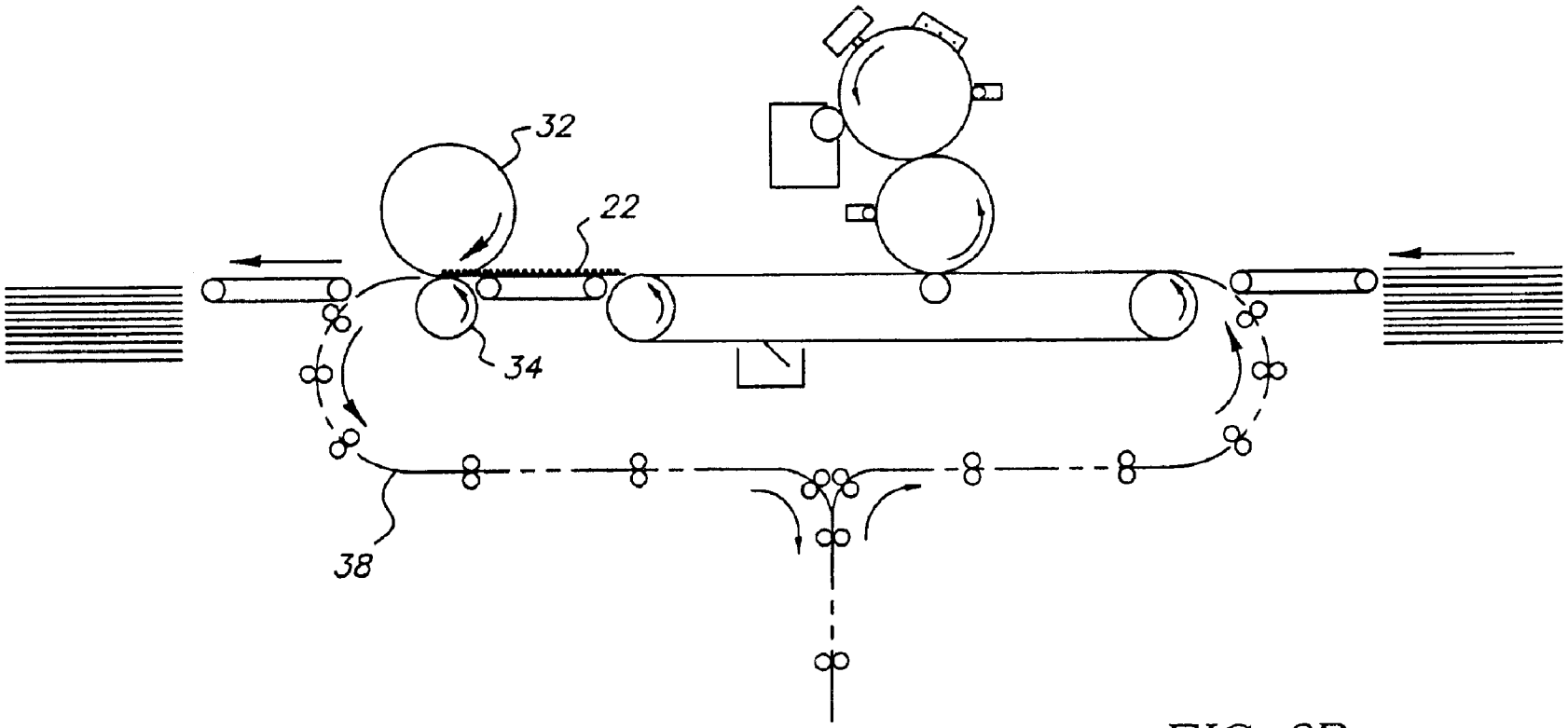
FIG. 2B is a schematic illustration of the same electrographic reproduction apparatus as in FIG. 2A with the receiver sheet, bearing a marking particle image on its first side, about to enter the nip between a fuser roller and a pressure roller.

The electrostatic latent image is then rendered visible by development subsystem 20, which deposits charged, pigmented marking particles onto the photoconductive member 14 in accordance with the electrostatic charge pattern of the latent image. The developed marking particle image is then transferred from photoconductive member 14 to intermediate transfer member 15. The electric field to transfer the marking particle image from photoconductive member 14 to intermediate transfer member 15 is provided by an appropriate bias voltage applied to intermediate transfer member 15. Cleaner 30 cleans any marking particles that are not transferred from the photoconductive member 14 to the intermediate transfer member 15. The marking particle image is then transferred from intermediate transfer member 15 to a receiver member 22 that has been fed from supply 24 onto a transport belt 26. The electric field to transfer the marking particle image from the intermediate transfer member 15 to the receiver member 22 is provided by electrically biased roller 28. In FIG. 2A the receiver member 22 is shown on the transport belt 26 about to enter the nip between the intermediate transfer member 15 and the electrically biased roller 28. Cleaner 31 cleans any marking particles that are not transferred from intermediate transfer member 15 to the receiver member 22. The receiver member 22 bearing the marking particle image is then transported, through the nip formed between fuser roller 32 and pressure roller 34 wherein the marking particle image is fused by heat and pressure to the receiver member 22. FIG. 2B shows the receiver member 22 about to enter the nip between the fuser roller 32 and the pressure roller 34.

The combination of elements including the imaging drum 12 on which is coated the photoconductive member 14, intermediate transfer member 15, the primary charging device 16, the exposure subsystem 18, the development subsystem 20, the electrically biased roller 28, and the cleaner 30 will henceforth be referred to as the imaging module. The electrographic reproduction apparatus 11 depicted in FIGS. 2A–2F could include a plurality of imaging modules in sequence along the length of the transport belt 26 for the purpose of creating and transferring different respective colored marking particle images to the receiver member 22 in superimposed register. The present invention is equally applicable to an electrographic reproduction apparatus with one imaging module or with a plurality of imaging modules.

Figure 2C:
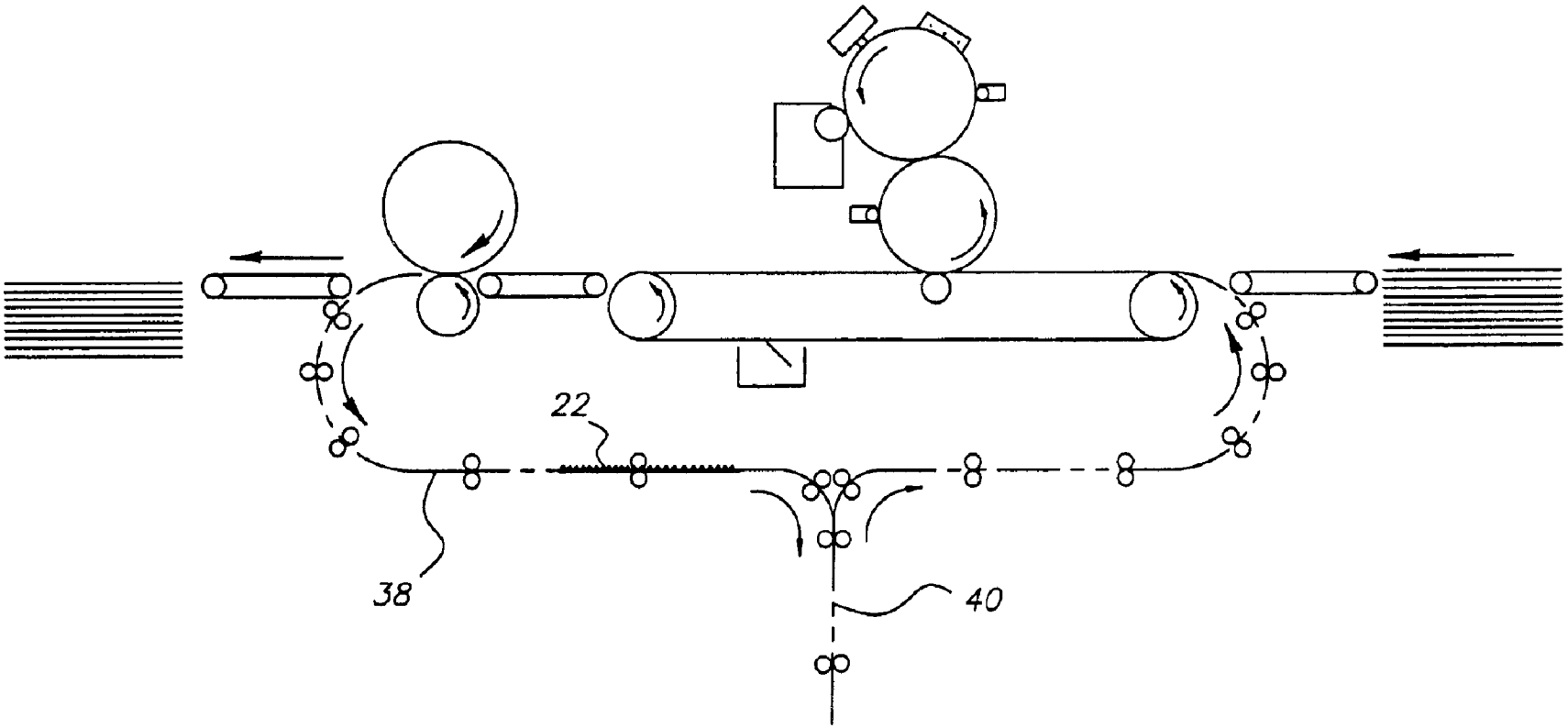
FIG. 2C is a schematic illustration of the same electrographic reproduction apparatus as in FIGS. 2A and 2B with the receiver sheet, bearing the fused marking particle image on its first side, about to enter a turn-over part of a duplex return path.
Figure 2D:
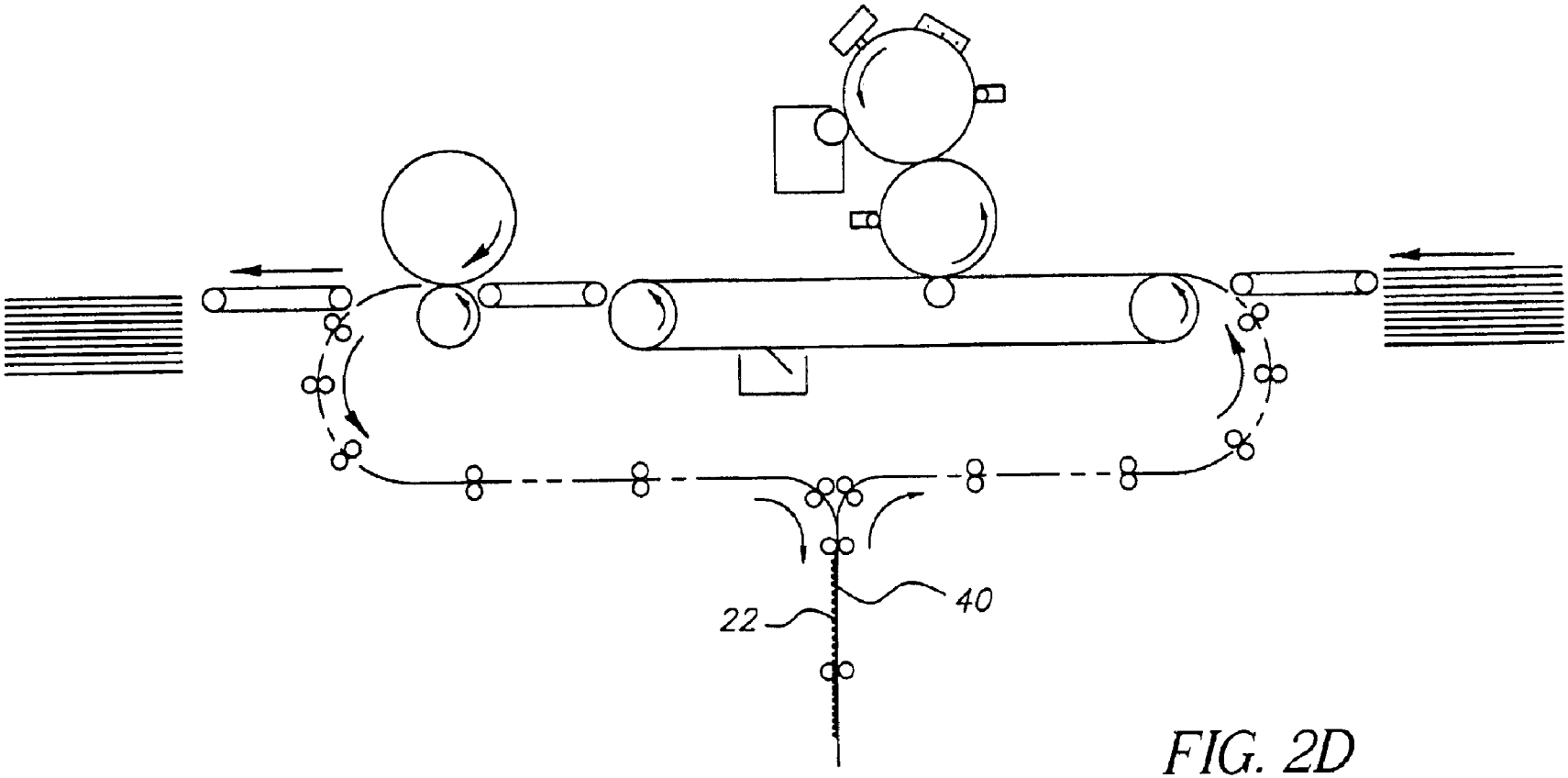
FIG. 2D is a schematic illustration of the same electrographic reproduction apparatus as in FIGS. 2A, 2B, and 2C with the receiver sheet, bearing the fused marking particle image on its first side, in the turn-over part of the duplex return path.
Figure 2E:
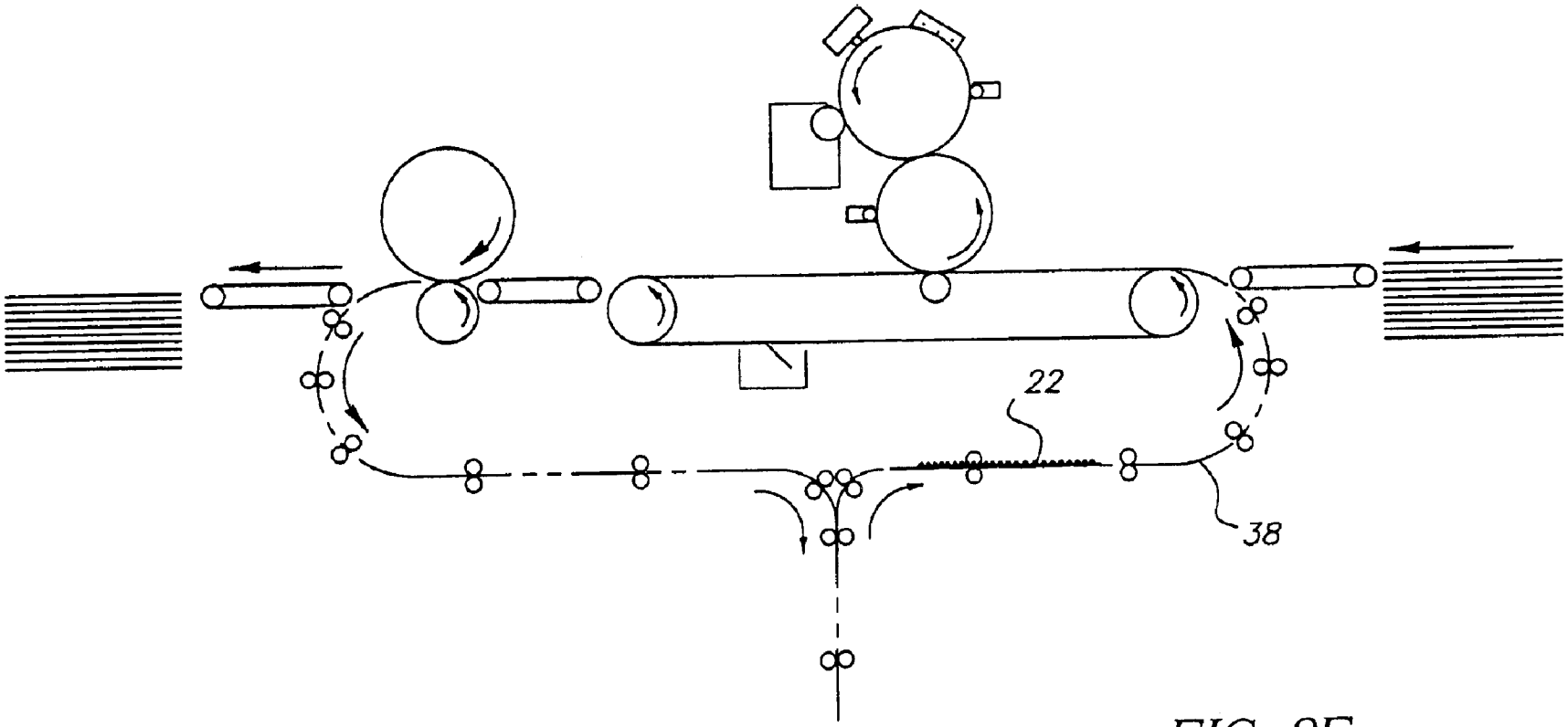
FIG. 2E is a schematic illustration of the electrographic reproduction apparatus in FIGS. 1A, 1B, 1C, and 1D with the receiver sheet, bearing the fused marking particle image on its first side, after exiting the turn-over part of the duplex return path.
Figure 2F:
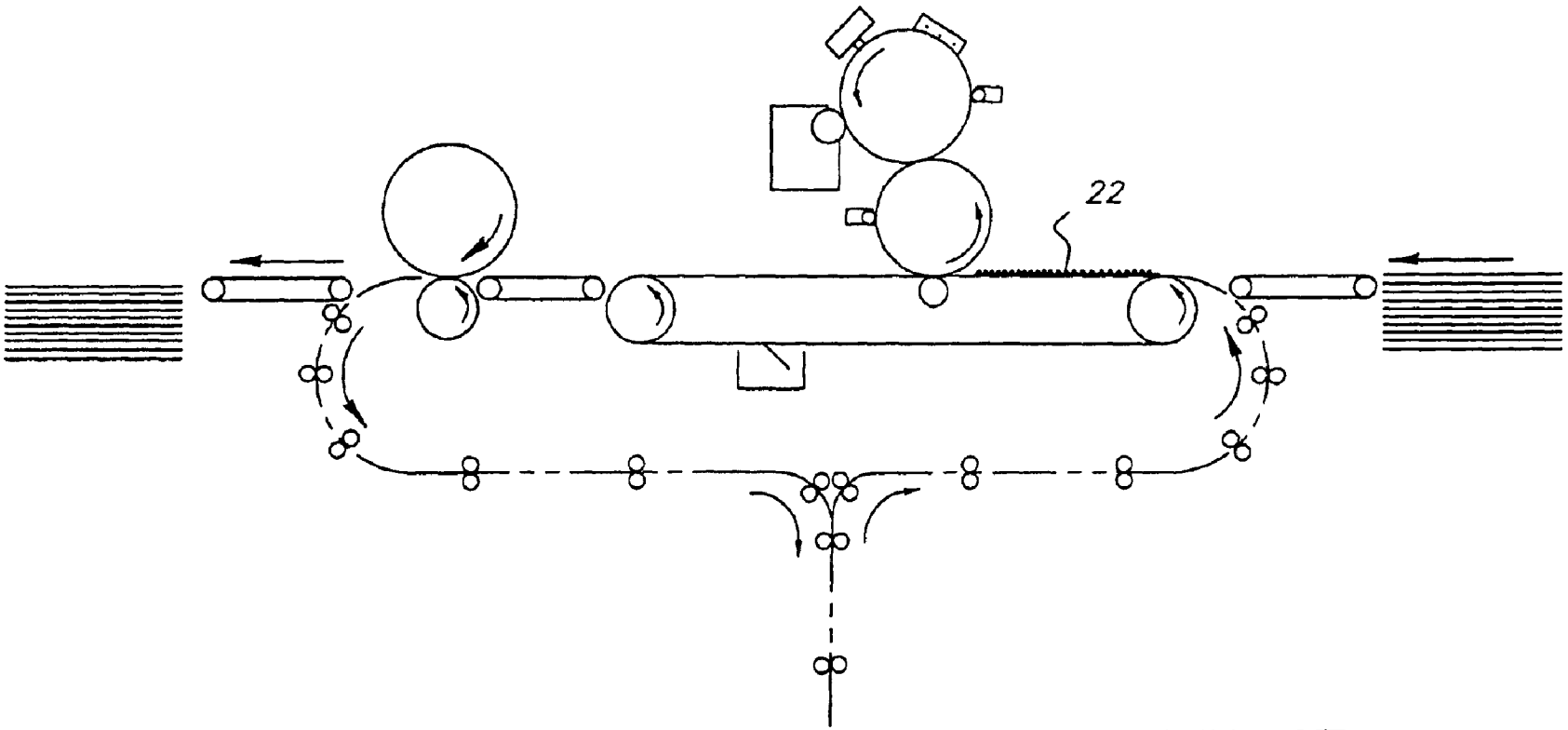
FIG. 2F is a schematic illustration of the electrographic reproduction apparatus in FIGS. 2A, 2B, 2C, 2D, and 2E with the receiver sheet, bearing the fused marking particle image on its first side, on the transport belt and about to enter the nip between the intermediate transfer member and the electrically biased transfer roller to have a marking particle image transferred to its second side.

The fuser roller 32 is heated to a temperature high enough to fuse the marking particle image to the receiver member 22 as the receiver member 22 is passed through the nip with the side bearing the marking particle image in contact with the fuser roller 32. FIG. 2B shows the receiver member 22 about to enter the nip between the fuser roller 32 and the pressure roller 34. After exiting the fuser nip, if the print job calls for an image on just side one of the receiver member 22, the receiver member 22 is transported to output stack 36. If the print job calls also for an image on side two of the receiver member 22, hereafter referred to as duplex printing, the receiver member 22 is not transported to the output stack 36, but rather is diverted to return path 38. FIG. 2C shows the receiver member 22 in the return path 38 after exiting the fuser. In return path 38 the receiver member 22 is turned over in turnover device 40 and returned to transport belt 26 whereupon a second marking particle image is transferred to side two of receiver member 22. FIG. 2D shows the receiver member 22 in the turnover device 40, FIG. 2E shows the receiver member 22 in the return path 38 after being turned over by the turnover device 40, and FIG. 2F shows the receiver member 22 back on the transport belt 26 prior to having a marking particle image transferred to its side two. The receiver member 22 bearing the marking particle image on side two is then transported through the nip formed between fuser roller 32 and pressure roller 34 wherein the marking particle image on side two of the receiver member 22 is fused by heat and pressure to side two of the receiver member 22. After exiting the fuser nip the receiver member 22, with images on both sides, is transported to output stack 36.

In order to prevent the receiver member 22 bearing the fused marking particle image from sticking to the fuser roller 32 as it exits the nip between fuser roller 32 and pressure roller 34, release oil is applied to the fuser roller 32. After exiting the nip between the fuser roller 32 and pressure roller 34, a quantity of the release oil typically remains on the receiver member 22 on the side that contacted the fuser roller 32. During duplex printing, when transferring the marking particle image to side two of the receiver member 22, some of the fuser release oil remaining on side one, from fusing of the side one marking particle image, transfers to the transport belt 26 which is in contact with side one of the receiver member 22. During a long duplex printing run a relatively large amount of fuser release oil can thereby accumulate on the transport belt 26.

During a printing run of the above process it is sometimes necessary to skip one or more imaging frames of photoconductive member 14. Non-imaging skip frames are created by not feeding receiver members 22 from supply 24 and inhibiting the digitally addressed exposure subsystem 18, such that no pigmented marking particles are developed onto said frames by development subsystem 20. One instance that non-imaging skip frames are required is during the production of a multiple page, collated document that are being duplex printed, and the number of pages in the document is not equal to an integral of the number of pages it takes to fill the return path 38. Another instance requiring non-imaging skip frames is if sequential receiver members 22, fed from different supplies, require different fuser set points, and additional time is needed to change the fuser set points. During non-imaging skip frames intermediate transfer member 15 is in direct contact with transport belt 26. As a result, fuser release oil accumulated on transport belt 26, as described above, transfers to intermediate transfer member 15. Fuser release oil can also transfer from transport belt 26 to intermediate transfer member 15 during cycle down at the end of a duplex printing run when intermediate transfer member 15 is again in direct contact with transport belt 26. Another opportunity for direct contact of intermediate transfer member 15 to transport belt 26 bearing oil is during recovery from a receiver jam during a duplex printing run. While purging receiver members 22 from the reproduction apparatus 11 after a shutdown due to a jam it is possible for direct contact of the intermediate transfer member 15 with the transport belt 26 during some frames. Fuser release oil contamination on the intermediate transfer member 15 will transfer to photoconductive member 14 and cause image quality defects.

The invention prevents the transfer of fuser release oil from transport belt 26 to intermediate transfer member 15 during non-imaging skip frames, cycle downs and jam recovery by depositing a uniform layer of marking particles onto photoconductive member 14, then transferring the uniform layer of marking particles to the intermediate transfer member 15 to form a barrier between the intermediate transfer member 15 and the transport belt 26 bearing oil. The logic and control system within the reproduction apparatus 11 controls the image printing process previously described, including creating non-imaging skip frames as required, the cycle down sequence, and the recovery from jams of receiver members 22. The logic and control system will determine/detect when frames on the transport belt 26 containing fuser release oil will come into direct contact with intermediate transfer member 15 due to non-imaging skip frames, cycle down, or jam recovery. The logic and control system then adjusts the operating parameters of the imaging module so that a uniform layer of marking particles is deposited onto the photoconductive member 14 by development subsystem 20, then transferring the uniform layer of marking particles to the intermediate transfer member 15 in areas that will directly contact the transport belt 26. For this purpose the imaging module operating parameters are set to a predetermined level so that the uniform layer of marking particles is at least a monolayer of the marking particles. The uniform layer of marking particles acts as a barrier to prevent transfer of fuser release oil from transport belt 26 to intermediate transfer member 15. The uniform layer of marking particles is transferred from the intermediate transfer member 15 directly to the transport belt 26 by biased transfer roller 28 and subsequently removed from transport belt 26 by scraper blade 42 and collected in receptacle 44. The fuser release oil from the transport belt 26 adheres to the marking particles and is removed along with the marking particles by scraper blade 42. As mentioned above, in an alternate embodiment, the uniform layer of marking particles could similarly be removed directly from the photoconductive member 14 or from the intermediate transfer member 15.

As described above, the transport belt 26 only accumulates fuser release oil during duplex printing when it comes into contact with the first side of receiver members 22 during the transfer of a developed marking particle image to the second side. Therefore, the method of the present invention may be activated only for non-imaging skip frames, cycle down, and jam recovery during duplex printing runs. In addition it has been determined that a minimum duplex printing run length is required before enough fuser release oil accumulates on transport belt 26 to cause image quality defects. Therefore, the method of the present invention may be activated only for non-imaging skip frames, cycle down, and jam recovery during duplex printing runs longer than this predetermined length.

The overall object of the present invention as described above is to prevent fuser oil contamination of intermediate transfer member 15. However, if an event should occur that is not anticipated by the logic and control system, during which the intermediate transfer member 15 is inadvertently contaminated with fuser release oil, another embodiment of the present invention provides a clean-up mode to the reproduction apparatus 11. The clean-up mode is initiated, for example, automatically or by the reproduction apparatus operator if observed print quality defects are believed to be due to fuser release oil contamination. In the clean-up mode the operating parameters of the imaging module are adjusted so that a uniform layer of marking particles is deposited continuously onto the photoconductive member 14, then transferred to intermediate transfer member 15 for a predetermined number of non-imaging cycles during which no receiver members 22 are fed from supply 24. The contaminating fuser release oil on intermediate transfer member 15 adheres to the marking particles and is carried away with the marking particles as the marking particles are transferred to transport belt 26. The fuser release oil bearing marking particles are then removed from transport belt 26 by scraper blade 42 and collected in receptacle 44. The predetermined number of cycles in the clean-up mode is sufficient to thus remove the contaminating fuser release oil from photoconductive member 14 and thereby eliminate the print quality defects caused therefrom. Again, as described above, an embodiment may be provided where the marking particle layer is not transferred from the photoconductive member 14 (or intermediate transfer member 15), but is similarly removed directly from the photoconductive member 14 (or intermediate transfer member 15).

In this embodiment depicted in FIGS. 2A–2F the exemplary device for removing the uniform layer of marking particles from, transport belt 26 is a scraper blade 42. Other well-known devices for cleaning marking particles from substrates in electrographic reproduction apparatus are vacuum assisted fiber brushes, electrically conductive fiber brushes, and magnetic brushes. All of these devices are well known in the art and therefore will not be described in detail here. All would serve equally well in place of the scraper blade 42 found in the above-recited embodiment.

The foregoing description details the embodiments most preferred by the inventors. Variations to the foregoing embodiments will be readily apparent to those skilled in the relevant art. Therefore the scope of the invention should be measured by the appended claims.

What is claimed is:

1. A method for controlling fuser release oil contamination in an electrostatographic reproduction apparatus comprising the steps of:

a. identifying events wherein a photoconductive member will operatively contact an electrically biased transfer member;

b. depositing a substantially uniform layer of charged pigmented marking particles onto said photoconductive member in the areas that will operatively contact said electrically biased transfer member; and c. removing said layer of charged pigmented marking particles, thereby removing fuser release oil.

2. The method of claim 1, wherein in said removing step, the charged pigmented marking particles are removed directly from said photoconductive member.

3. A method for controlling fuser release oil contamination in an electrostatographic reproduction apparatus comprising the steps of:

a. identifying events wherein a photoconductive member will operatively contact an electrically biased transfer member;

b. depositing a substantially uniform layer of charged pigmented marking particles onto said photoconductive member in the areas that will operatively contact said electrically biased transfer member;

c. transferring said layer of charged pigmented marking particles from said photoconductive member directly to said electrically biased transfer member; and d. removing said layer of charged pigmented marking particles from said electrically biased transfer member with a cleaning mechanism, thereby removing fuser release oil from said electrically biased transfer member.

4. The method of claim 3, wherein said electrically biased transfer member is a roller.

5. The method of claim 3, wherein said electrically biased transfer member is a receiver transport belt.

6. The method of claim 3, wherein said substantially uniform layer of charged pigmented marking particles comprises at least a complete monolayer of said charged pigmented marking particles.

7. The method of claim 3, wherein said steps a–d are executed only during duplex printing runs of said electrostatographic reproduction apparatus.

8. The method of claim 7, wherein said steps a–d are executed only during duplex printing runs longer than a predetermined minimum run length.

9. In an electrostatographic reproduction apparatus having an intermediate transfer member and a final transfer member, a method of controlling fuser release oil contamination comprising the steps of:

a. identifying events wherein said intermediate transfer member will operatively contact said final transfer member;

b. depositing a substantially uniform layer of charged pigmented marking particles onto said intermediate transfer member in the areas that will operatively contact said final transfer member; and c. removing said layer of charged pigmented marking particles with a cleaning mechanism, thereby removing fuser release oil.

10. The method of claim 9, wherein in said removing step, the charged pigmented marking particles are removed directly from said intermediate transfer member.

11. In an electrostatographic reproduction apparatus having an intermediate transfer member and a final transfer member, a method of controlling fuser release oil contamination comprising the steps of:

a. identifying events wherein said intermediate transfer member will operatively contact said final transfer member;

b. depositing a substantially uniform layer of charged pigmented marking particles onto said intermediate transfer member in the areas that will operatively contact said final transfer member;

c. transferring said layer of charged pigmented marking particles from said intermediate transfer member to said final transfer member; and d. removing said layer of charged pigmented marking particles from said final transfer member with a cleaning mechanism, thereby removing fuser release oil from said final transfer member.

12. The method of claim 11, wherein said final transfer member is a roller.

13. The method of claim 11, wherein said final transfer member is a receiver transport belt.

14. The method of claim 11, wherein said substantially uniform layer of charged pigmented marking particles comprises at least a complete monolayer of said charged pigmented marking particles.

15. The method of claim 11, wherein said steps a–d are executed only during duplex printing runs of said electrostatographic reproduction apparatus.

16. The method of claim 15, wherein said steps a–d are executed only during duplex printing runs longer than a predetermined minimum run length.

17. A method for removing fuser release oil contamination from an electrostatographic reproduction apparatus comprising the steps of:

a. for a predetermined number of cycles, depositing a substantially uniform layer of charged pigmented marking particles onto a photoconductive member; and b. removing said layer of charged pigmented marking particles with a cleaning mechanism, thereby removing fuser release oil.

18. A method of claim 17, wherein in said removing step, the charged pigmented marking particles are removed directly from said photoconductive member.

19. A method for removing fuser release oil contamination from an electrostatographic reproduction apparatus comprising the steps of:

a. for a predetermined number of cycles, depositing a substantially uniform layer of charged pigmented marking particles onto a photoconductive member;

b. transferring said layer of charged pigmented marking particles from said photoconductive member operatively to an electrically biased transfer member; and c. removing said layer of charged pigmented marking particles from said electrically biased transfer member with a cleaning mechanism, thereby removing fuser release oil from said electrically biased transfer member.

20. The method of claim 19, wherein said electrically biased transfer member is a roller.

21. The method of claim 19, wherein said electrically biased transfer member is a receiver transport belt.

22. The method of claim 19, wherein said substantially uniform layer of charged pigmented marking particles comprises at least a complete monolayer of said charged pigmented marking particles.

23. The method of claim 19, wherein said steps a–c are executed only during duplex printing runs of said electrostatographic reproduction apparatus.

24. The method of claim 23, wherein said steps a–c are executed only during duplex printing runs longer than a predetermined minimum run length.

25. In an electrostatographic reproduction apparatus having an intermediate transfer member and a final transfer member, a method of removing fuser release oil contamination comprising the steps of:

a. for a predetermined number of cycles, depositing a substantially uniform layer of charged pigmented marking particles onto said intermediate transfer member in the areas that will operatively contact said final transfer member; and b. removing said layer of charged pigmented marking particles with a cleaning mechanism, thereby removing fuser release oil.

26. The method of claim 25, wherein in said removing step, the charged pigmented marking particles are removed directly from said intermediate transfer member.

27. In an electrostatographic reproduction apparatus having an intermediate transfer member and a final transfer member, a method of removing fuser release oil contamination comprising the steps of:

a. for a predetermined number of cycles, depositing a substantially uniform layer of charged pigmented marking particles onto said intermediate transfer member;

b. transferring said layer of charged pigmented marking particles from said intermediate transfer member to said final transfer member; and c. removing said layer of charged pigmented marking particles from said final transfer member with a cleaning mechanism, thereby removing fuser release oil from said final transfer member.

28. The method of claim 27, wherein said final transfer member is a roller.

29. The method of claim 27, wherein said final transfer member is a receiver transport belt.

30. The method of claim 27, wherein said substantially uniform layer of charged pigmented marking particles comprises at least a complete monolayer of said charged pigmented marking particles.

31. The method of claim 27, wherein said steps a–c are executed only during duplex printing runs of said electrostatographic reproduction apparatus.

32. The method of claim 31, wherein said steps a–c are executed only during duplex printing runs longer than a predetermined minimum run length.

* * * * *